US012599252B2

(12) United States Patent
Prizzi et al.

(10) Patent No.: US 12,599,252 B2
(45) Date of Patent: Apr. 14, 2026

(54) ORGANIZER WALL PANEL ASSEMBLY

(71) Applicant: 2840629 ONTARIO INC., Woodbridge (CA)

(72) Inventors: Giuseppe Prizzi, Kleinburg (CA); Marcello Venafro, Toronto (CA)

(73) Assignee: 2840629 ONTARIO INC., Woodbridge (CA)

( * ) Notice: Subject to any disclaimer, the term of this patent is extended or adjusted under 35 U.S.C. 154(b) by 0 days.

(21) Appl. No.: 17/669,292

(22) Filed: Feb. 10, 2022

(65) Prior Publication Data

US 2022/0248874 A1 Aug. 11, 2022

Related U.S. Application Data

(63) Continuation-in-part of application No. 17/173,603, filed on Feb. 11, 2021, now abandoned.

(51) Int. Cl.
*A47F 5/08* (2006.01)

(52) U.S. Cl.
CPC ..... *A47F 5/0853* (2013.01)

(58) Field of Classification Search
CPC ..... A47F 5/0853; A47F 5/0846; E04F 13/18; E04F 2203/04; E04F 13/076;
(Continued)

(56) References Cited

U.S. PATENT DOCUMENTS 5,050,362 A * 9/1991 Tal ..... E04D 3/363 52/579
6,332,733 B1 * 12/2001 Hamberger ..... C08L 81/06 52/592.4

(Continued)

FOREIGN PATENT DOCUMENTS

WO WO-2021059179 A1 4/2021

OTHER PUBLICATIONS

Non-Final Office Action issued in U.S. Appl. No. 17/173,603, dated Jun. 16, 2021.

(Continued)

*Primary Examiner* — Ko H Chan
(74) *Attorney, Agent, or Firm* — SMART & BIGGAR LP; James Raakman; Justin Philpott

(57) ABSTRACT

Disclosed is a panel comprising an interacting portion, defining a covering portion and a first panel-defined interacting counterpart. The interacting portion is biased to a pre-deformation configuration, wherein the interacting portion is tapering rearwardly. At least a portion of the interacting portion is deformable from the pre-deformation configuration for effectuating transitioning of the interacting portion to an interference-effective deformed configuration, wherein the transitioning includes a forwardly displacement of the first panel-defined interacting counterpart. The first panel-defined interacting counterpart and a second panel-defined interacting counterpart, of a second panel, are configurable for disposition in a relative movement interference relationship, wherein interference, to relative movement, between the panels, is established. While the first panel-defined interacting counterpart and the second panel-defined interacting counterpart are disposed in the relative movement interference relationship, and the second panel is connected to a wall with a fastener, the covering portion of the panel is covering the fastener.

12 Claims, 5 Drawing Sheets

(58) Field of Classification Search
CPC ..... E04F 15/02038; E04F 13/0894; E04F 13/0889; E04F 15/10; E04F 2201/0146; E04F 2201/041; E04F 2201/043; E04F 2201/044; E04F 2201/042; E04F 2201/023; E04F 2201/0138; G09F 13/0413; G09F 15/0006; E04C 2/38; E04B 1/54
See application file for complete search history.

(56) References Cited

U.S. PATENT DOCUMENTS

| | | | | |
|---|---|---|---|---|
| 7,306,107 | B2 * | 12/2007 | Secondino | A47F 5/0846 211/94.01 |
| 8,353,140 | B2 | 1/2013 | Pervan et al. | |
| 9,803,374 | B2 * | 10/2017 | Pervan | E04F 15/107 |
| 10,477,966 | B2 | 11/2019 | Parrington et al. | |
| 11,208,814 | B2 * | 12/2021 | De Rick | E04F 15/10 |
| 2006/0213142 | A1 | 9/2006 | Albracht | |
| 2009/0133353 | A1 * | 5/2009 | Pervan | E04F 15/02033 52/747.1 |
| 2010/0293879 | A1 * | 11/2010 | Pervan | E04F 15/02038 52/588.1 |
| 2011/0258959 | A1 * | 10/2011 | Braun | E04F 15/02 52/588.1 |
| 2021/0087832 | A1 * | 3/2021 | Boo | E04F 15/102 |

OTHER PUBLICATIONS

Final Office Action issued in U.S. Appl. No. 17/173,603, dated Apr. 7, 2022.
Advisory Action issued in U.S. Appl. No. 17/173,603, dated Jun. 30, 2022.
Non-Final Office Action issued in U.S. Appl. No. 17/173,603, dated Jul. 28, 2022.
Examination Report issued in Australian Patent Application No. 2022200842, dated Apr. 3, 2023.
Final Office Action issued in U.S. Appl. No. 17/173,603, dated Dec. 5, 2022.
Non-Final Office Action issued in U.S. Appl. No. 17/173,603, dated Apr. 17, 2023.
Final Office Action issued in U.S. Appl. No. 17/173,603, dated Jul. 26, 2023.
Advisory Action issued in U.S. Appl. No. 17/173,603, dated Oct. 17, 2023.
Final Office Action issued in U.S. Appl. No. 17/173,603, dated Oct. 31, 2023.

* cited by examiner

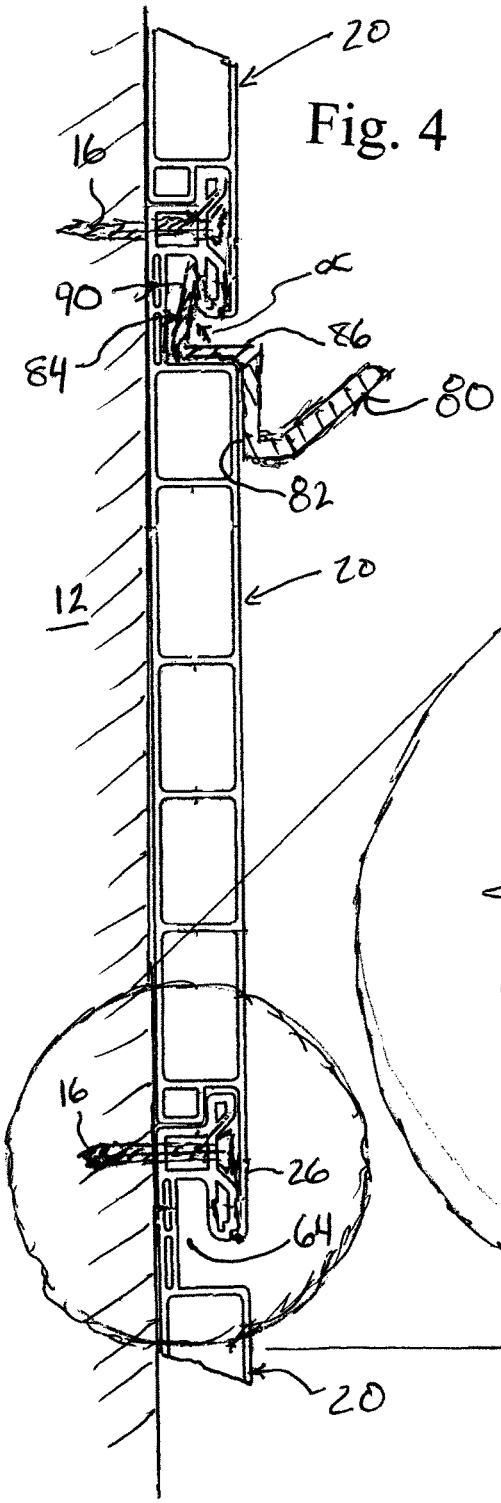
Fig. 4
Fig. 5
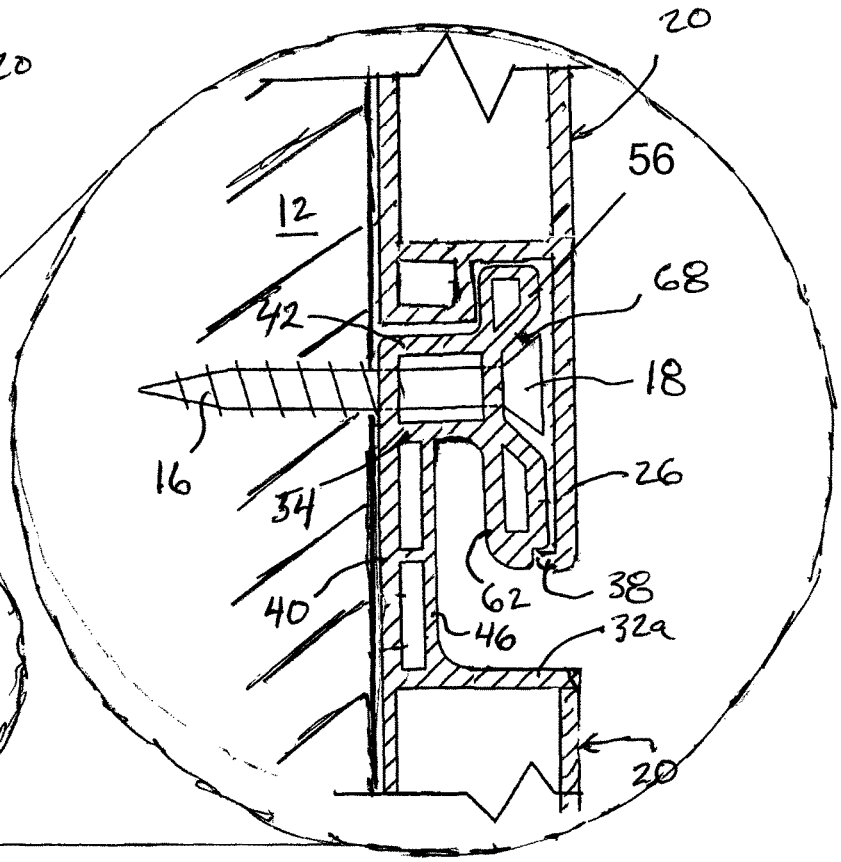

ORGANIZER WALL PANEL ASSEMBLY

FIELD

The present invention relates to an organizer wall panel assembly, and more particularly an organizer wall panel assembly formed from a number of stackable, modular panels, which are configured for use and securement as a wall section in substitution for part or all of a conventional dry wall sheet.

BACKGROUND

The construction of organizer wall panel assemblies by securing in place, a series of stacked, individual wall panels is well known. U.S. Pat. No. 7,306,107 to Secondino describes an earlier panel construction which individual wall panels are adapted for interconnection with horizontally adjacent panels in the erection of an organizer wall. In some embodiments, for example, conventional panels used in organizer wall applications are typically formed as an elongated hollow extrusion and have variable lengths of between six and twelve feet, a vertical height of eight (8) inches, and lateral thickness of ¾ inches. The panels are formed with a longitudinal, "L-shaped" mounting groove which is sized to receive the bent end of a hangar member or bracket used to hang power or garden tools, garden equipment as well as other items, and which is formed with normally extending horizontal and vertical segments configured for complementary placement within the groove.

The applicant has appreciated that organizer walls formed from conventional panels suffer the disadvantage that the wider thickness of the profile frequently necessitates the assembly of conventional panels as a whole-wall application, where the panels are arranged to extend vertically fully from the floor to the ceiling. In particular, the added thickness of the panel extrusion prevents the easy integration of the wall panel assembly with conventional dry wall sheets, as part of a finished wall section. As a result, conventionally such panels are installed either over the top, or in place of conventional thy wall sheets, at increased costs.

In addition, the erection of organizer wall panel assemblies with panels arranged in a whole-wall arrangement results in the presence of mounting grooves in areas adjacent to the floor and ceiling with no practical functionality to the user. In addition to significantly increased production costs compared to the cost of securing conventional dry wall sheets, the requirement to install individual organizer wall panels individually, is far more labour intensive and time consuming.

SUMMARY

To at least partially overcome some of the difficulties associated with conventional organizer wall panel constructions, the present invention provides an organizer wall panel assembly which is adapted for integration into a conventional wall construction, in place of part or all of a conventional half inch thick sheet of dry wall or gypsum board.

In some embodiments, for example, the present invention provides for an organizer wall panel assembly which is formed at least in part from a series of horizontally stacked, longitudinally elongated panels. In some embodiments, for example, each of the panels, independently, is manufactured using plastic or aluminum and are extruded or molded with a constant horizontal profile and variable longitudinal length of up to 20 feet, for example, between 8 to 16 feet. In some embodiments, for example, the panels have a generally modular construction, allowing the panels to be secured in place in a horizontal edge-to-edge arrangement in no particular order. The panels are formed having a generally rectangular body, an upper connecting portion which with the body forms an elongate mounting groove, and a lower covering flange portion.

In some embodiments, for example, the body is formed as a mostly hollow construction having a generally planar front and rear surface. The rear surface is adopted for juxtaposed placement and mounting to a wall or wall studs. The front surface is generally parallel to the rear surface and is spaced therefrom to provide the panel body with a lateral thickness substantially corresponding to a thickness of a conventional drywall sheet. In some embodiments, for example, the lateral thickness of the body that is from 0.4 inches to 0.7 inches, for example, from 0.5 inches to 0.6 inches.

The lower covering flange portion projects downwardly past the lower extent of the panel body. In some embodiments, for example, the covering flange portion is formed as a resiliently deformable web which is integral with the lower edge of the front panel surface. In some embodiments, for example, with the panel in a mounted arrangement, the covering flange portion extends downwardly below the body by a distance selected to overlie at least part of the connecting portion of a next lower adjacent panel or dry wall sheet. The covering flange portion further includes a rearwardly tapering lowermost edge portion. The tapering edge portion bends or curves rearwardly downwardly towards the rear of the panel. In some embodiments, for example, the lowermost edge of the covering flange portion is spaced rearwardly from the plane of the panel body front surface by a distance that is from 0.030 inches to 0.150 inches, for example, from 0.040 inches and 0.080 inches, towards the panel rear. In some embodiments, for example, the lowermost edge of the covering flange portion is spaced rearwardly from the plane of the panel body front surface by a distance of 0.0625 inches, towards the panel rear.

In some embodiments, for example, the upper connecting portion is integrally formed with the panel body as a single molding or extrusion. In some embodiments, for example, the panel is provided whereby the upper connecting portion is adapted for engagement with the lower edge of a next vertically adjacent panel in a mated fit arrangement. In some embodiments, for example, the upper connecting portion extends vertically by a distance that is from one (1) inch to two (2) inches from the upper edge of panel body. The connecting portion is provided with a fastener receiving portion which is sized to receive a nail, screw or other suitable mechanical fastener thereto, in the securement of the panel in place against the wall. The fastener receiving portion is connected to the panel body towards or along its rearward side by a vertical web. Horizontally extending shoulder and arm members, respectively project upwardly and downwardly along forward portions the fastener receiving portion. The fastener receiving portion, arm member and panel body comprise to define an L-shaped shaped mounting groove sized to receive therein, the bent or hooked ends of one or more mounting brackets.

The applicant has appreciated that a number of panels may be assembled in a horizontally stacked, side-by-side arrangement together with one or more conventional dry wall sheets. Such an arrangement may provide a finished wall section which incorporates into part of the wall only, an organizer panel wall assembly which provides for hangar member retaining mounting grooves only in selected or preselected areas, having regard to customer preferences.

In some embodiments, for example, a number of stackable panels of the present invention may be adapted for securement directly to wall studs in place of a conventional dry wall sheet to provide an organizer wall panel assembly which extends vertically as only part of a conventional wall section. Where the lower extent of the wall section is finished with a conventional dry wall sheet, the covering flange portion of a lowermost positioned wall panel is provided overlying a horizontal upper edge of the conventional dry wall sheet. In such an arrangement, the rearwardly tapering portion of the covering flange portion is urged into resilient contact against the adjacent thy wall panel, to provide a visually finished edge.

In some embodiments, for example, the organizer wall panel assembly is adapted for use with hangar members/brackets which incorporate a hooked mounting end sized for mated placement within the mounting groove in an edge-fit manner. In some embodiments, for example, the hooked end includes a generally horizontal web portion which extends inwardly from a rear portion of the hangar bracket adapted for juxtaposed placement against the panel front surface to an upwardly extending finger portion. In some embodiments, for example, the finger portion extends angularly upward from the innermost edge of the horizontal web at an angle that is from 55 to 85 degrees, for example, 65 to 75 degrees, for example, 70 to 80 degrees relative thereto. The extent and angular orientation of the finger portion is selected to engage a rearwardmost portion of the arm member, and assist in maintaining bearing contact between the panel body and rear portion of the hangar member when under load.

In some embodiments, for example, the upper connecting portion is provided with a guide groove or other visual indicia for use guiding placement of mechanical fasteners through the fastener receiving portion at desired positions. The upper connecting portion may further be provided with one or more longitudinally extending channels, slots or recesses which are adapted for mated engagement with complementary formed members provided on the covering flange portion of a next adjacent upper panel.

Accordingly, in one aspect the present invention resides in an organizer wall panel assembly comprising a plurality of stackable panels having the substantially the same height and width, each said panel comprising a generally rectangular panel body having front surface, a wall engaging rear surface and horizontally extending upper and lower edges; an horizontally extending upper connecting portion, and a lower horizontally extending covering flange portion, the rear surface extending generally in a first plane, the front surface extending generally in a second plane parallel to and spaced laterally forward from the first plane by a distance that is from 0.5 inches to 0.65 inches, the upper connecting portion including, a vertical connecting web extending vertically upward from the upper edge and having a rear portion substantially coplanar with the rear surface and adapted for juxtaposed placement with said wall, a fastener receiving portion joined to the vertical connecting web, the fastener receiving portion being spaced rearwardly from the second plane and including a fastener pierceable body adapted to receive a mechanical fastener therethrough, and upwardly extending shoulder member and a downwardly extending arm member, the shoulder member projecting upwardly from the pierceable body to define at least in part a longitudinally extending channel groove therewith, the arm member projecting downwardly from the pierceable body a distance part way towards the upper edge, wherein the arm member, pierceable body and panel body define at least in part a longitudinally extending retention groove sized for receiving an end portion of a hooked member therein, the covering flange portion being integral with and extending downwardly from the front surface a distance selected to substantially overly the fastener receiving portion of a next lower panel when positioned adjacent thereto, the covering flange portion tapering rearwardly to a bottom panel edge portion, the bottom panel edge portion being resiliently deformable between an unbiased position, wherein the bottom edge portion is spaced by a distance that is from 0.030 inches to 0.150 inches, for example, from 0.040 inches to 0.080 inches, rearwardly from the second plane, and a biased position wherein the bottom edge portion is moved towards coplanar alignment with the second plane.

In another aspect, the present invention resides in an organizer wall panel assembly comprising a plurality of stackable panels having the substantially the same height and width, said panels being secured to a wall in a stacked side-by-side arrangement, each said panel comprising a generally rectangular hollow panel body having front surface, a wall engaging rear surface and horizontally extending upper and lower edges; an upper horizontally extending connecting portion, and a lower horizontally extending covering flange portion, the rear surface extending generally in a first plane, the front surface extending generally in a second plane parallel to and spaced laterally forward from the first plane by a distance that is from 0.5 inches and 0.65 inches, the upper connecting portion including, a vertical connecting web extending vertically upward from the upper edge and having a rear portion substantially coplanar with the rear surface and adapted for juxtaposed placement with said wall, a fastener receiving portion joined to the vertical connecting web, the fastener receiving portion being spaced rearwardly from the second plane and including a fastener pierceable body adapted to receive a mechanical fastener therethrough, and upwardly extending shoulder member and a downwardly extending arm member, the shoulder member projecting upwardly from the pierceable body to define at least in part a longitudinally extending channel groove therewith, the arm member projecting downwardly from the pierceable body a distance part way towards the upper edge, wherein the arm member, pierceable body and panel body define at least in part a longitudinally extending retention groove sized for receiving an end portion of a hooked member therein, the lower edge, further including a horizontally extending boss, the boss sized for mated placement within the channel groove of a next lower-panel when positioned adjacent thereto, the covering flange portion being integral with and extending downwardly from the front surface a distance selected to substantially overly the fastener receiving portion of the next lower panel, the covering flange portion tapering rearwardly to a bottom panel edge portion, the bottom panel edge portion being resiliently movable from an unbiased position, wherein the bottom edge portion is spaced a distance that is from 0.030 inches to 0.150 inches, for example, from 0.040 inches to 0.080 inches, rearwardly from the second plane to a biased position wherein the bottom edge portion is moved forwardly by a deflected distance that is from 0.030 inches to 0.150 inches, for example, from 0.040 inches to 0.080 inches.

The present invention additionally provides various further non-limiting aspects, and which include without restriction as follows:

1. An organizer wall panel according to any of the foregoing or hereafter described aspects, wherein the panel body comprises a substantially hollow body, having inner and outer walls having a thickness that is from 0.020 inches to 0.070 inches, for example, 0.050 inches.

2. An organizer wall panel according to any of the foregoing or hereafter described aspects wherein, wherein the wall panels comprise modular wall panels wherein the panel body extends from the channel groove to the bottom of the panel body with a vertical height that is from 5.75 inches to 6.25 inches and/or the covering flange extends with a vertical thickness that is from 0.8 inches to 1.2 inches.
3. An organizer wall panel according to any of the foregoing or hereafter described aspects wherein a groove is provided between the shoulder member and arm member, and/or includes a visual indicia selected from the group consisting of a guide bevel, a molded starter line or other molded indicators, selected to indicate a desired mechanical fastener position.
4. An organizer wall panel according to any of the foregoing or hereafter described aspects, wherein the shoulder member and the arm member define a longitudinally extending groove therebetween, the groove being sized to substantially receive therein the entirety of a head portion of said mechanical fastener.
5. An organizer wall panel according to any of the foregoing or hereafter described aspects, wherein a forwardmost portion of the fastener receiving portion is spaced a distance rearwardly from the second plane.
6. An organizer wall panel according to any of the foregoing or hereafter described aspects, wherein the arm member includes a horizontally extending slot, the bottom edge portion including a rearwardly projecting rib adapted for resilient mated positioning in the slot of the next lower panel positioned adjacent thereto.
7. An organizer wall panel according to any of the foregoing or hereafter described aspects, wherein each of said panels comprise modular interchangeable panels formed as a unitary plastic, aluminum or polyvinyl chloride (PVC) extrusion.
8. An organizer wall panel according to any of the foregoing or hereafter described aspects, wherein said panel body includes a plurality of reinforcing webs spanning horizontally from said rear surface to said front surface, at least three of said reinforcing webs positioned for bearing contact with said hangar bracket when said tab is provided in engagement with said retention groove.
9. An organizer wall panel according to any of the foregoing or hereafter described aspects, wherein the first groove is further provided with a V-shaped notch, and in the installed position of a plurality of panels the fastening means are secured through the V-shaped notches.

In one aspect, there is provided an organizer wall panel assembly comprising a plurality of stackable panels having the substantially the same height and width, each said panel comprising a generally rectangular panel body having front surface, a wall engaging rear surface and horizontally extending upper and lower edges; an horizontally extending upper connecting portion, and a lower horizontally extending covering flange portion, the rear surface extending generally in a first plane, the front surface extending generally in a second plane parallel to and spaced laterally forward from the first plane, the upper connecting portion including, a vertical connecting web extending vertically upward from the upper edge and having a rear portion substantially coplanar with the rear surface and adapted for juxtaposed placement with said wall, a fastener receiving portion joined to the vertical connecting web, the fastener receiving portion being spaced rearwardly from the second plane and including a fastener pierceable body adapted to receive a mechanical fastener therethrough, and upwardly extending shoulder member and a downwardly extending arm member, the shoulder member projecting upwardly from the pierceable to define at least in part a longitudinally extending channel groove therewith, the arm member projecting downwardly from the pierceable body a distance part way towards the upper edge, wherein the arm member, pierceable body and panel body define at least in part a longitudinally extending retention groove seized for receiving an end portion of a hooked member therein, the covering flange portion being integral with and extending downwardly from the front surface a distance selected to substantially overly the fastener receiving portion of a next lower panel when positioned adjacent thereto, the covering flange portion tapering rearwardly to a bottom panel edge portion, the bottom panel edge portion being resiliently deformable between an unbiased position, wherein the bottom panel edge portion is spaced rearwardly from the second plane, and a biased position wherein the bottom panel edge portion is moved towards coplanar alignment with the second plane.

In another aspect, there is provided an organizer wall panel assembly comprising a plurality of stackable panels having the substantially the same height and width, said panels being secured to a wall in a stacked side-by-side arrangement, each said panel comprising a generally rectangular hollow panel body having front surface, a wall engaging rear surface and horizontally extending upper and lower edges; an upper horizontally extending connecting portion, and a lower horizontally extending covering flange portion, the rear surface extending generally in a first plane, the front surface extending generally in a second plane parallel to and spaced laterally forward from the first plane, the upper connecting portion including, a vertical connecting web extending vertically upward from the upper edge and having a rear portion substantially coplanar with the rear surface and adapted for juxtaposed placement with said wall, a fastener receiving portion joined to the vertical connecting web, the fastener receiving portion being spaced rearwardly from the second plane and including a fastener pierceable body adapted to receive a mechanical fastener therethrough, and upwardly extending shoulder member and a downwardly extending arm member, the shoulder member projecting upwardly from the pierceable body to define at least in part a longitudinally extending channel groove therewith, the arm member projecting downwardly from the pierceable body a distance part way towards the upper edge, wherein the arm member, pierceable body and panel body define at least in part a longitudinally extending retention groove sized for receiving an end portion of a hooked member therein, the lower edge further including a horizontally extending boss, the boss sized for mated placement within the channel groove of a next lower-panel when positioned adjacent thereto, the covering flange portion being integral with and extending downwardly from the front surface a distance selected to substantially overly the fastener receiving portion of the next lower panel, the covering flange portion tapering rearwardly to a bottom panel edge portion, the bottom panel edge portion being resiliently movable from an unbiased position, wherein the bottom panel edge portion being resiliently movable from an unbiased position, wherein the bottom panel edge portion is spaced a distance that is from 0.030 inches to 0.150 inches, rearwardly from the second plane to a biased position wherein the bottom panel edge portion is moved forwardly by a deflected distance that is from 0.030 inches to 0.150 inches.

In another aspect, there is provided a panel, defining a front-facing surface and a rear-facing surface, wherein the rear-facing surface is disposed, relative to the front-facing surface, on an opposite side of the panel, wherein the panel is configured for mounting to a wall such that the rear-facing surface is opposing the wall, wherein the panel comprises: an interacting portion, extending from the front-facing surface, and defining: a covering portion; and a first panel-defined interacting counterpart; wherein: the interacting portion is urged by a bias to a pre-deformation configuration, wherein, in the pre-deformation configuration, the extending of the interacting portion from the front-facing surface is with effect that the interacting portion is tapering rearwardly from the front-facing surface; at least a portion of the interacting portion is deformable from the pre-deformation configuration for effectuating transitioning of the interacting portion to an interference-effective deformed configuration, wherein the transitioning includes a forwardly displacement of the first panel-defined interacting counterpart; the panel is configured for defining a first panel which is co-operable with a second panel, the second panel being co-operable with a fastener for effectuating connection of the second panel to a wall with the fastener, wherein the co-operability of the first panel with the second panel is such that: the first panel-defined interacting counterpart and a second panel-defined interacting counterpart, of the second panel, are configurable for disposition in a relative movement interference relationship, wherein, in the relative movement interference relationship: the interacting portion is disposed in the interference-effective deformed configuration; and interference, to relative movement, between the first panel and the second panel, is established; the bias urges resistance to defeating of the relative movement interference relationship; and while the first panel-defined interacting counterpart and the second panel-defined interacting counterpart are disposed in the relative movement interference relationship, and the second panel is connected to a wall with a fastener, the covering portion of the first panel is covering the fastener.

In another aspect, there is provided panel, defining a front-facing surface and a rear-facing surface, wherein the rear-facing surface is disposed, relative to the front-facing surface, on an opposite side of the panel, wherein the panel is configured for mounting to a wall such that the rear-facing surface is opposing the wall, wherein the panel comprises: an interacting portion defining: a covering portion; and a first panel-defined interacting counterpart; wherein: the interacting portion is urged by a bias to a pre-deformation configuration; at least a portion of the interacting portion is deformable from the pre-deformation configuration for effectuating transitioning of the interacting portion to an interference-effective deformed configuration; the panel is configured for defining a first panel which is co-operable with a second panel, the second panel being co-operable with a fastener for effectuating connection of the second panel to a wall with the fastener, wherein the co-operability of the first panel with the second panel is such that: the first panel-defined interacting counterpart and a second panel-defined interacting counterpart, of the second panel, are configurable for disposition in a relative movement interference relationship, wherein, in the relative movement interference relationship: the interacting portion is disposed in the interference-effective deformed configuration; and the first panel-defined interacting counterpart is bearing against the second panel-defined interacting counterpart, such that there is established: an interference, to relative movement, between the first panel and the second panel, and an urging of resistance to defeating of the relative movement interference relationship by the bias; and while the first panel-defined interacting counterpart and the second panel-defined interacting counterpart are disposed in the relative movement interference relationship, and the second panel is connected to a wall with a fastener, the covering portion of the first panel is covering the fastener.

In another aspect, there is provided a panel, defining a front-facing surface and a rear-facing surface, wherein the rear-facing surface is disposed, relative to the front-facing surface, on an opposite side of the panel, wherein the panel is configured for mounting to a wall such that the rear-facing surface is opposing the wall, wherein the panel comprises: an interacting portion, extending from the front-facing surface, and defining: a covering portion; and a first panel-defined interacting counterpart; wherein: the interacting portion is urged by a bias to a pre-deflection configuration, wherein, in the pre-deflection configuration, the extending of the interacting portion from the front-facing surface is with effect that the interacting portion is tapering rearwardly from the front-facing surface; the interacting portion is deflectable from the pre-deflection configuration to an interference-effective deflected configuration, such that a deflection of the interacting portion, from the pre-deflection configuration to the interference-effective deflected configuration, is obtainable, wherein the deflection from the pre-deflection configuration includes a forwardly displacement of the first panel-defined interacting counterpart; the panel is configured for defining a first panel which is co-operable with a second panel, the second panel being co-operable with a fastener for effectuating mounting of the second panel to a wall with the fastener, wherein the co-operability of the first panel with the second panel is such that: the first panel-defined interacting counterpart and a second panel-defined interacting counterpart, of the second panel, are configurable for disposition in a relative movement interference relationship, wherein, in the relative movement interference relationship: the interacting portion is disposed in the interference-effective deflected configuration; and interference, to relative movement, between the first panel and the second panel, is established; the bias urges resistance to defeating of the relative movement interference relationship; and while the first panel-defined interacting counterpart and the second panel-defined interacting counterpart are disposed in the relative movement interference relationship, and the second panel is connected to a wall with a fastener, the covering portion of the first panel is covering the fastener.

In another aspect, there is provided a panel, defining a front-facing surface and a rear-facing surface, wherein the rear-facing surface is disposed, relative to the front-facing surface, on an opposite side of the panel, wherein the panel is configured for mounting to a wall such that the rear-facing surface is opposing the wall, wherein the panel comprises: an interacting portion defining: a covering portion; and a first panel-defined interacting counterpart; wherein: the interacting portion is urged by a bias to a pre-deflection configuration; the interacting portion is deflectable from the pre-deflection configuration to an interference-effective deflected configuration, such that a deflection of the interacting portion, from the pre-deflection configuration to the interference-effective deflected configuration, is obtainable; the panel is configured for defining a first panel which is co-operable with a second panel, the second panel being co-operable with a fastener for effectuating connection of the second panel to a wall with the fastener, wherein the co-operability of the first panel with the second panel is such that: the first panel-defined interacting counterpart and a second panel-defined interacting counterpart, of the second panel, are configurable for disposition in a relative movement interference relationship, wherein, in the relative movement interference relationship: the interacting portion is disposed in the interference-effective deflected configuration; and the first panel-defined interacting counterpart is bearing against the second panel-defined interacting counterpart, such that there is established: an interference, to relative movement, between the first panel and the second panel, and an urging of resistance to defeating of the relative movement interference relationship by the bias; and while the first panel-defined interacting counterpart and the second panel-defined interacting counterpart are disposed in the relative movement interference relationship, and the second panel is connected to a wall with a fastener, the covering portion of the first panel is covering the fastener.

Other aspects will be apparent from the description and drawings provided herein.

BRIEF DESCRIPTION OF DRAWINGS

Reference may now be bad to the following detailed description taken together with the accompanying drawings in which:

FIG. 4 shows a perspective end view illustrating the interlocking positioning of a number of panels shown in FIG. 2 in a stacked edge-to-edge arrangement in the erection of the organizer wall panel assembly shown in FIG. 1.

FIG. 5 shows an enlarged view illustrating the interlocking securement of adjacent panels shown in FIG. 4.

DETAILED DESCRIPTION

Figure 1:
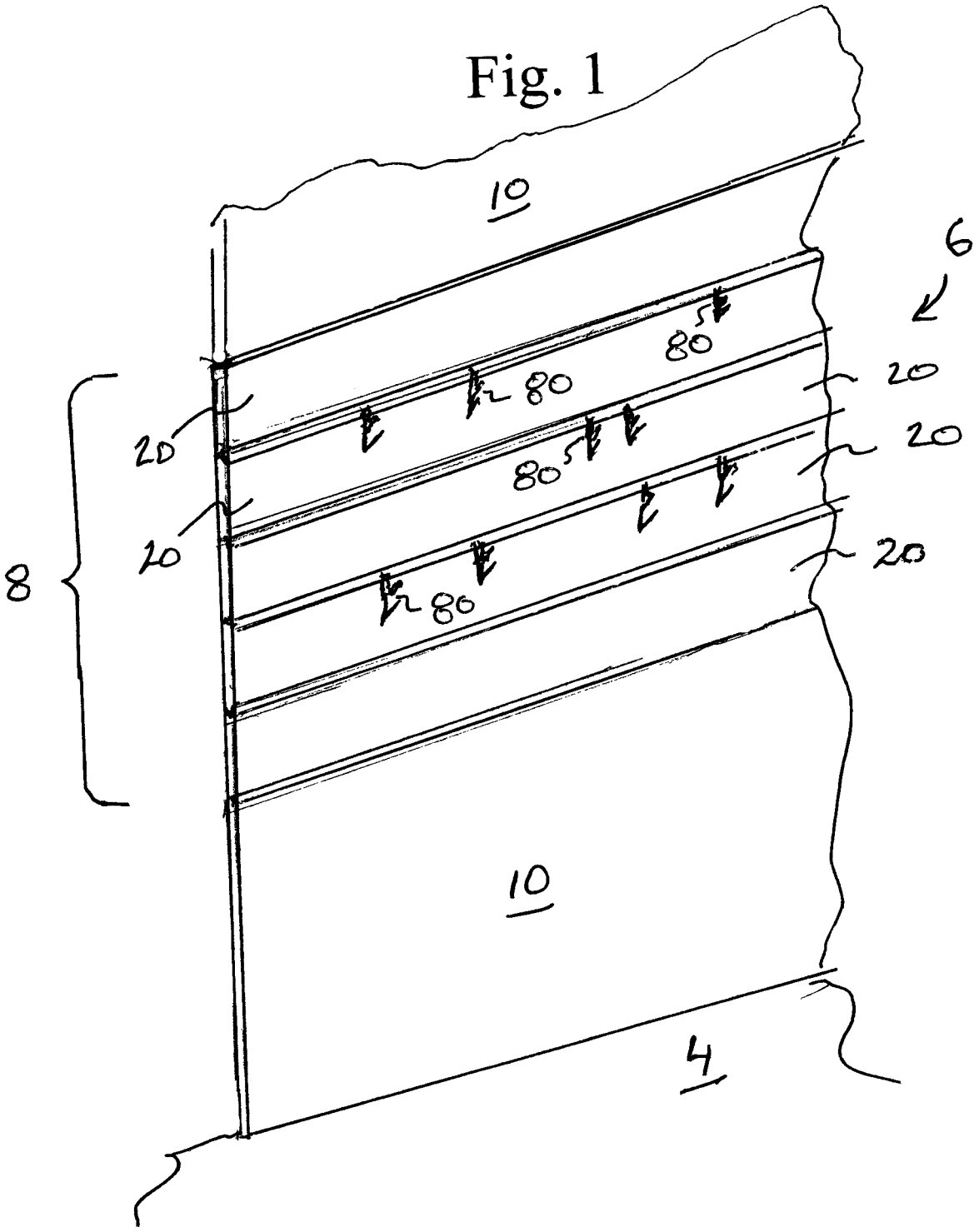
FIG. 1 shows a partial perspective view of a wall section which incorporates an organizer wall panel assembly in accordance with an example embodiment of the invention.

Referring to FIG. 1, which illustrates a finished wall section 6 which incorporates organizer wall panel assembly 8 in accordance with an example embodiment of the invention. As will be described, in addition to the organizer wall panel assembly 8, the finished wall section 6 incorporates one or more conventional half inch dry wall sheets 10 and a series in individual modular organizer panels 20 which are mounted to the wall studs 12, as illustrated in FIG. 4. In some embodiments, for example, the panel 20 is configured for mounting to a wall.

As is illustrated in FIG. 1, the organiser wall panel assembly 8 is provided at a height spaced above the floor 4, and forms a section of the finished wall 6 and has an overall vertical extent selected at between 2 and 6 feet, for increased efficiency, and reduced manufacturing and installation costs. It is to be appreciated however, that depending on individual user requirements, the organizer wall panel assembly 8 may be provided with a greater or lessened vertical height, or if desired, could extend the full vertical height of the wall 6.

Figure 2:
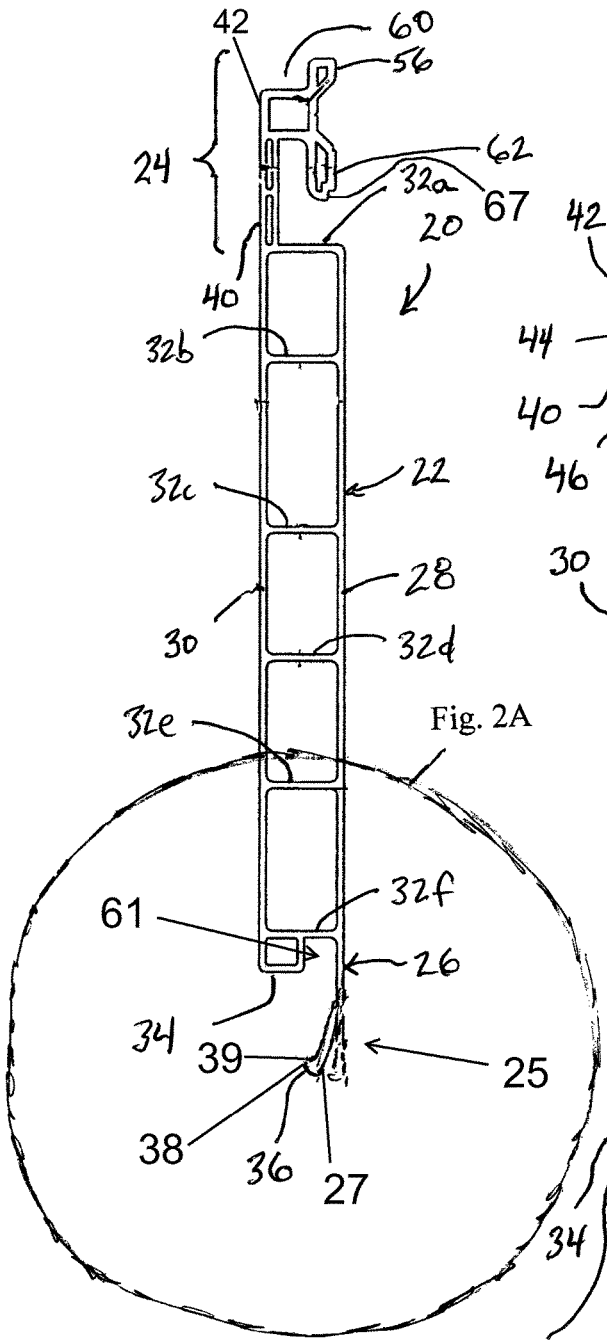
FIG. 2 shows an elevation end view of a modular panel used in the construction of an organizer wall panel assembly in accordance with an example embodiment of the invention.

Referring to FIG. 2, which illustrates an organizer panel 20 used in the organizer panel wall assembly 8 in accordance with an example embodiment of the invention. Each one of the panels 20, independently, is provided with a modular construction having a constant cross-sectional profile. The panels 20 are adapted for use and assembly in a horizontally stacked edge-to-edge arrangement with both additional identical panels 20 as shown with reference to FIG. 1, and with one or more conventional dry wall sheets 10 in the construction of the finished wall section 6.

Each panel 20 is provided as interchangeable panels having a unitary construction. In some embodiments, for example, the material of the panel 20 includes plastic or aluminum. In some embodiments, for example, the material of the panel 20 includes polyvinylchloride (PVC). In some embodiments, for example the panel 20 is an extrusion. The panel 20 has an overall vertical height that is from five (5) to eight (8) inches, for example, from six (6) to seven (7) inches, and may be provided with a variable longitudinal length. In some embodiments, for example, the length of the panel is from six (6) feet to 16 feet; for example, from eight (8) feet to 12 feet. Longer or shorter panels 20 may however be provided depending on the final application.

Figure 2A:
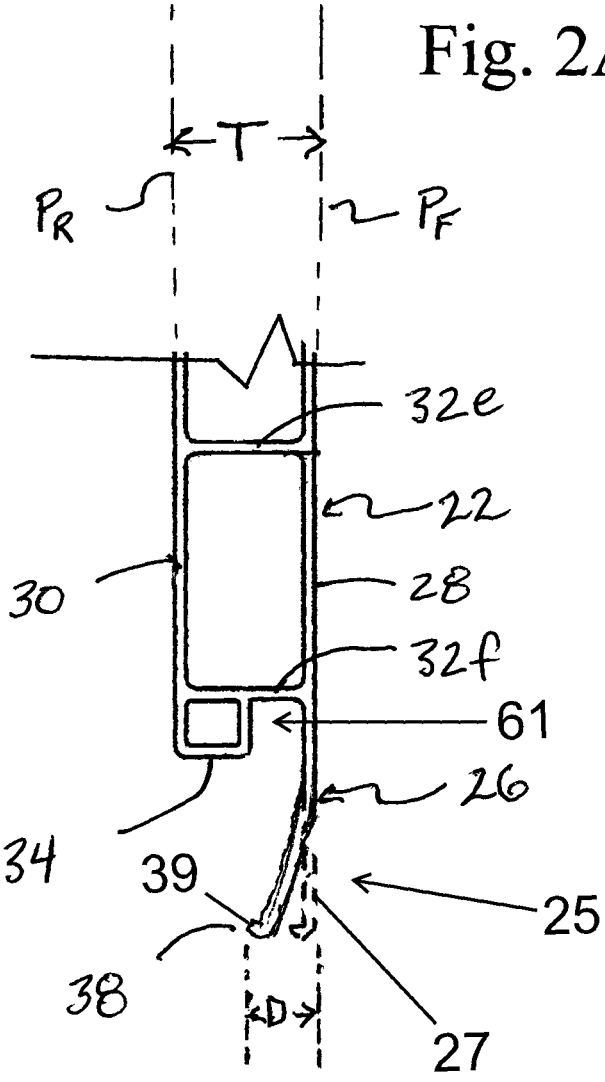
FIG. 2A shows an enlarged view of the lower covering flange portion of the panel illustrated in FIG. 2.

FIGS. 2 and 2A illustrate each panel 20 as having a generally rectangular panel body 22. The panel body 22 is formed having a generally hollow, rectangular construction, having generally planar front surface 28, or front-facing surface 28, and rear surface 28, or rear-facing surface 30. FIG. 2A illustrates the front and rear surfaces 28, 30 as being substantially planar and respectively lying in parallel, spaced apart planes PF and PR. In some embodiments, for example, the rear-facing surface 30 is disposed, relative to the front-facing surface 28, on an opposite side of the panel 20. In some embodiments, for example, the panel 20 is configured for mounting to the wall or wall stud 12 such that the rear-facing surface 30 is opposing the wall or the wall stud 12, In some embodiments, for example, to facilitate simplified use of the panel 20 with the conventional dry wall sheets 10, the construction of the finished wall 6, the front and rear surfaces 28, 30 are provided with a lateral spacing selected to provide the panel 20 with a maximum lateral thickness T from 0.5 inches to 0.65 inches. In some embodiments, for example, the panel body 22 has an overall vertical height that is from 4.5 inches to 5.5 inches, however longer or shorter constructions may be provided. FIG. 2 shows the front and rear surfaces 28, 30 being connected at each of their top and bottom edges, and as middle intervals by a series of spaced integral transverse reinforcing webs 32*a-f*. In some embodiments, for example, to minimize panel deformation under higher load conditions, each of the front and rear surfaces 28, 30 and reinforcing webs 32*a-f*, independently, is formed with a thickness that is from 0.020 inches to 0.2 inches, such as, for example, 0.020 inches to 0.070 inches, such as, for example, 0.050 inches. It is to be appreciated however, that thinner or thicker front and/or rear surfaces 28, 30 and/or webs 32 may be provided, depending on the panel material selection.

Figure 3:
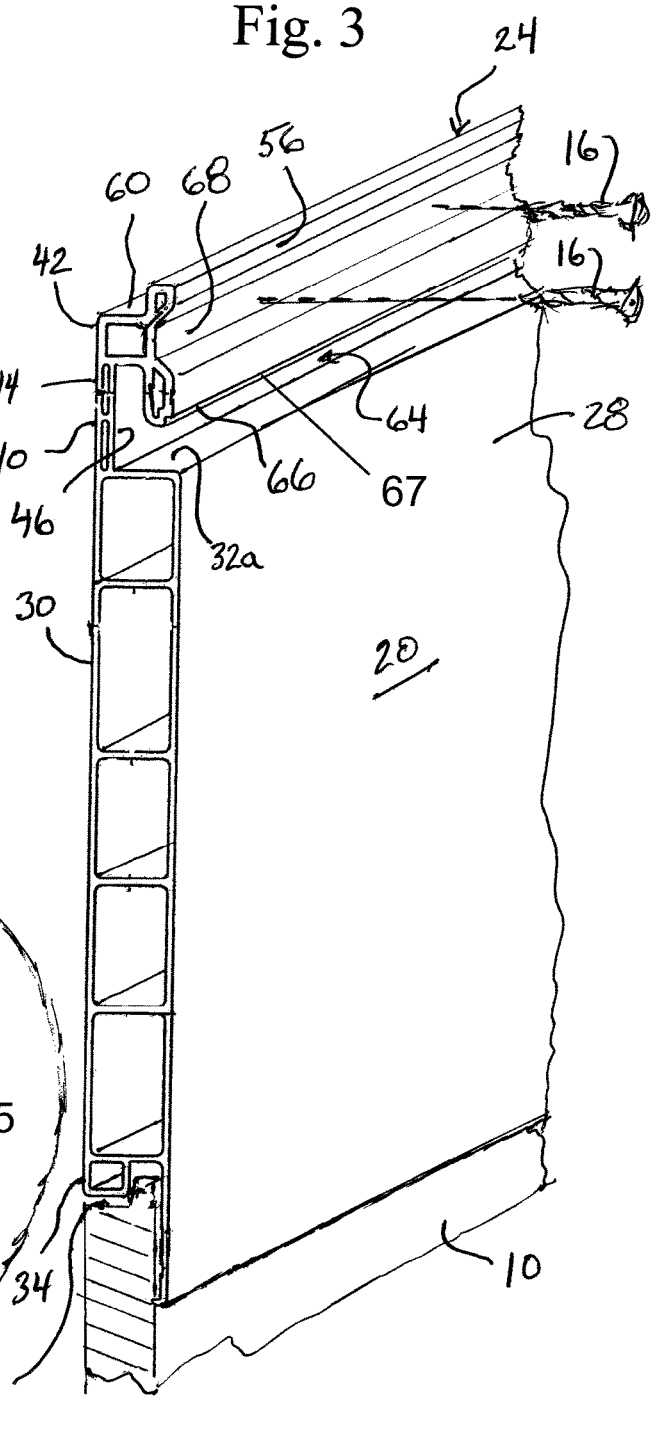
FIG. 3 shows a perspective end view illustrating the positioning of a panel shown in FIG. 2 in an arrangement overlapping a conventional dry wall panel, in the construction of a wall section in accordance with the example embodiment.

FIG. 2 illustrates the lower edge of the panel body 22 as further including a horizontally extending rectangular boss 34. The boss 34 extends downwardly along the rearward most edge of the body 22 and is integral with the rear surface 30 and lowermost web 32*f*. In some embodiments, for example, the boss 34 extends forward laterally from the plane PR of the rear surface 30 a distance that is less than 0.3 inches, such as, for example, from 0.3 inches to 0.15 inches, such as, for example, from 0.2 inches to 0.25 inches. In a simplified construction, the boss 34 is formed as a generally square projection; however, other geometries are possible. As shown in FIGS. 3 and 4, in some embodiments, for example, the formation of the boss 34 is selected to allow its mated placement within either a bevel groove 14 formed along the upper rear portion of the dry wall sheet 10, or a channel groove 60 provided in a next lower panel 20, to assist in maintaining the securement of the panel 20 in a vertical orientation against the studs 12.

As illustrated in FIGS. 2 and 3, the panel 20 includes an upper connecting portion 24, configured for connection, for example, securement, of the panel 20 an adjacent panel 20, as part of a stacked edge-to-edge array in the organizer panel assembly 8 of FIG. 1. The upper connecting portion 24 of the panel 20 is shown in FIG. 2 as including a double-walled connecting web 40 and a fastener receiving portion 42. The connecting web 40 is shown as having a generally planar rearwardmost wall 44 which is integral with and co-planar with the panel body rear surface 30 at its lower end, and the fastener receiving portion 42 at its upper end. In some embodiments, for example, a secondary reinforcing wall 46 may be positioned forwardly and spaced from the wall 44. The secondary reinforcing wall 46 spans between the upper and panel body 22 and connecting portion 24 for added rigidity. One or more reinforcing webs may further be provided between the rearwardmost wall 44 and reinforcing wall 46, for additional structural support.

FIGS. 4 and 5 illustrate the upper connecting portion 24 as including a generally rectangular fastener receiving portion 42 integrally formed with the connecting web 40. The fastener receiving portion 42 includes a hollow, fastener pierceable body 54. As shown in FIG. 4, the pierceable body 54 has a generally cross-sectional profile and is sized to receive a mechanical screw fastener 16 therethrough. A horizontally extending shoulder member 56 projects upwardly along a forward edge portion of the pierceable body 54. In some embodiments, for example, the shoulder member 56 extends vertically by a distance that is from 0.2 inches to 0.5 inches and with the pierceable body 54 defines the longitudinally extending channel groove 60. The channel groove 60 is sized to receive in a complimentary fit therein, the lower edge boss 34 of a next, horizontally adjacent panel 20.

As shown in FIGS. 4 and 5, in some embodiments, for example, the shoulder member 56 is configured to be received in a channel groove 61 defined between the boss 34 and an interacting portion 25 of an adjacent panel 20, to assist in maintaining the securement of the panel 20 in a vertical orientation against the studs 12. In some embodiments, for example, disposition of the shoulder member 56 in the channel groove 61 is with effect that the panel 20 and the adjacent panel 20 become disposed in a coupled relationship, for example, an interference fit relationship or a friction fit relationship.

A horizontally extending arm member 62 extends downwardly from the forward edge portion of the pierceable body 54 generally vertically aligned beneath the shoulder member 56. In some embodiments, for example, the arm member 62 extends part way, for example, approximately half way towards the upper edge 32*a* of the panel body 22. In some embodiments, for example, the shoulder member 56 and arm member 62 extend to a forwardmost distance which is spaced rearwardly from the plane PF. The configuration of the fastener receiving portion 42 is selected to allow for the positioning of a covering flange portion 26 of a next upper adjacent panel 20, in a position substantially overlying the fastening receiving portion 52, in a generally co-planar arrangement with the plane PF.

In some embodiments, for example, the shoulder member 56 and arm member 62 define a fastener receiving groove 68 therebetween. The fastener receiving groove 68 is sized to substantially receive therein head portion 18 of the screw fasteners 16, when inserted through the fastener pierceable body 54 in the mechanical securement of the panel 20 to the wall studs 12.

As illustrated in FIGS. 2 and 2A, the panel 20 includes an interacting portion 25. The interacting portion 25 extends from the front-facing surface 28, and defines a covering portion 26, for example, a covering flange portion 26, and a first panel-defined interacting portion 38, for example, a rearwardly projecting rib 38.

In some embodiments, for example, the interacting portion 25 is urged by a bias to a pre-deformation configuration (illustrated in solid line in FIG. 2A). In some embodiments, for example, in the pre-deformation configuration, the extending of the interacting portion 25 from the front-facing surface 28 is with effect that the interacting portion 25 is tapering rearwardly from the front-facing surface 28.

In some embodiments, for example, at least a portion of the interacting portion 25 is deformable from the pre-deformation configuration (illustrated in solid line in FIG. 2A) for effectuating transitioning of the interacting portion 25 to an interference-effective deformed configuration (illustrated in stippled line in FIG. 2A), In some embodiments, for example, the transitioning of the interacting portion 25 from the pre-deformation configuration to the interference-effective deformed configuration includes a forwardly displacement of the first panel-defined interacting counterpart 38. In some embodiments, for example, the forwardly displacement of the first panel-defined interacting counterpart 38 for transitioning of the interacting portion 25 from the pre-deformation configuration to the interference-effective deformed configuration is a displacement of the first panel-defined interacting counterpart 38 in a forwardly direction. In some embodiments, for example, the forwardly displacement of the first panel-defined interacting counterpart 38 for transitioning of the interacting portion 25 from the pre-deformation configuration to the interference-effective deformed configuration includes a displacement of the first panel-defined interacting counterpart 38 by a distance of at least 0.030 inches in a forwardly direction. In some embodiments, for example, the forwardly displacement of the first panel-defined interacting counterpart 38 for transitioning of the interacting portion 25 from the pre-deformation configuration to the interference-effective deformed configuration includes a displacement of the first panel-defined interacting counterpart 38 by a distance of 0.0625 inches in a forwardly direction.

In some embodiments, for example, the ratio of: (i) the length of the interacting portion 25, and (ii) the forwardly displacement of the first panel-defined interacting counterpart 38 for transitioning of the interacting portion 25 from the pre-deformation configuration to the interference-effective deformed configuration, has a minimum value of at least 3:1.

In some embodiments, for example, the panel 20 is configured for defining a first panel 20 which is co-operable with a second panel 20. In some embodiments, for example, the second panel 20 is co-operable with a fastener 16 for effectuating connection of the second panel 20 to a wall with the fastener 16. In some embodiments, for example, the co-operability of the first panel with the second panel is such that. the first panel-defined interacting counterpart 38 and a second panel-defined interacting counterpart 66, for example, a longitudinally extending notch 66, of the second panel 20, are configurable for disposition in a relative movement interference relationship, as depicted in FIG. 4 and FIG. 5. In the relative movement interference relationship, the interacting portion 25 is disposed in the interference-effective deformed configuration, and interference, to relative movement, between the first panel 20 and the second panel 20, is established.

In some embodiments, for example, while the first panel-defined interacting counterpart 38 and the second panel-defined interacting counterpart 66 are disposed in the relative movement interference relationship, the first panel-defined interacting counterpart 38 is engaging the second panel-defined interacting counterpart 66, such that the interference, to relative movement, between the first panel 20 and the second panel 20, is established.

In some embodiments, for example, while the first panel-defined interacting counterpart 38 and the second panel-defined interacting counterpart 66 are disposed in the relative movement interference relationship, the first panel-defined interacting counterpart 38 is bearing against the second panel-defined interacting counterpart 66, such that the interference, to relative movement, between the first panel 20 and the second panel 20, is established.

In some embodiments, for example, the co-operability of the first panel 20 with the second panel 20 is such that: the first panel-defined interacting counterpart 38 and the second panel-defined interacting counterpart 66, of the second panel 20, are configurable for disposition in the relative movement interference relationship, wherein, in the relative movement interference relationship: the interacting portion 25 is disposed in the interference-effective deformed configuration; and the first panel-defined interacting counterpart 38 is bearing against the second panel-defined interacting counterpart 66, such that there is established: (i) an interference, to relative movement, between the first panel 20 and the second panel 20, and (ii) an urging of resistance to defeating of the relative movement interference relationship by the bias of the interacting portion 25.

In some embodiments, for example, while the first panel-defined interacting counterpart 38 and the second panel-defined interacting counterpart 66 are disposed in the relative movement interference relationship, the first panel-defined interacting counterpart 38 is disposed in snap fit engagement with the second panel-defined interacting counterpart 66, such that the interference, to relative movement, between the first panel 20 and the second panel 20, is established.

In some embodiments, for example, while the first panel-defined interacting counterpart 38 and the second panel-defined interacting counterpart 66 are disposed in the relative movement interference relationship, the first panel-defined interacting counterpart 38 and the second panel-defined interacting counterpart 66 are disposed in opposing relationship.

In some embodiments, for example, as illustrated in FIG. 2, FIG. 2A, and FIG. 3, the first panel-defined interacting counterpart 38 defines a first panel-defined opposing surface 39 and the second panel-defined interacting counterpart 66 defines a second panel-defined opposing surface 67, and, while the first panel-defined interacting counterpart 38 and the second panel-defined interacting counterpart 66 are disposed in the relative movement interference relationship, the first panel-defined opposing surface 39 and the second panel-defined opposing surface 67 are disposed in opposing relationship.

In some embodiments, for example, the front facing surface 28 defines a planar surface, and, while the first panel-defined interacting counterpart 38 and the second panel-defined interacting counterpart 66 are disposed in the relative movement interference relationship, an axis, normal to the first panel-defined opposing surface 39, is parallel to an axis that is normal to the planar front facing surface 28.

In some embodiments, for example, the front facing surface 28 is a planar surface, the covering portion 26 defines a front-facing covering portion surface 27 that is a planar surface, as illustrated in FIG. 4 and FIG. 5, and while the interacting portion 25 is disposed in the interference-effective deflected configuration, the front-facing covering portion 27 is co-planar with the planar front facing surface 28.

In some embodiments, for example, the bias of the interacting portion 25 urges resistance to defeating of the relative movement interference relationship of the first panel 20 and the second panel 20.

In some embodiments, for example, the bias of the interacting portion 25 is a material bias of the interacting portion 25.

In some embodiments, for example, the transitioning of the interacting portion 25 from the pre-deformation configuration to the interference-effective deformed configuration is effected by elastic deformation of the interacting portion 25. In this respect, in some embodiments, for example, the interacting portion 25 is elastically deformable.

Figure 6:
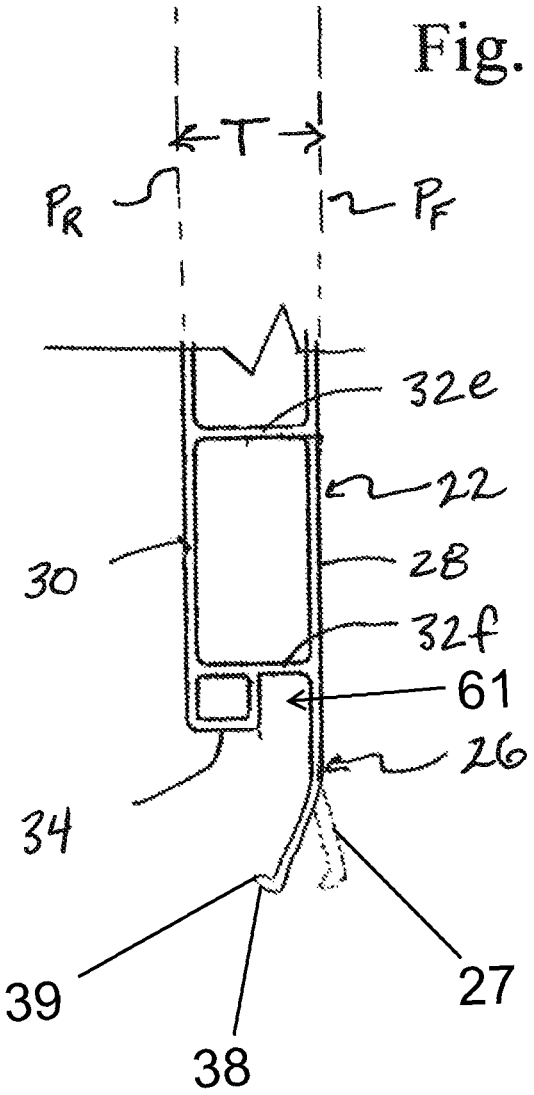
FIG. 6 shows an enlarged view of the lower covering flange portion of the panel illustrated in FIG. 2.

In some embodiments, for example, as illustrated in FIG. 6, the deformability of the at least a portion of the interacting portion 25 from the pre-deformation configuration, shown in solid lines in FIG. 6, is also for effectuating transitioning of the interacting portion 25 to a transitioning-effective deformed configuration, shown in stippled lines in FIG. 6. While the interacting portion 25 is disposed in the transitioning-effective deformed configuration, and the second panel 20 is disposed in a co-operative alignment with the interacting portion 25, the interacting portion 25 is urged, by the bias of the interacting portion 25, for displacement, relative to the second panel 20, with effect that the interacting portion 25 of the first panel 20 becomes disposed in the interference-effective deformed configuration.

In some embodiments, for example, the transitioning of the interacting portion 25 from the pre-deformation configuration to the transitioning-effective deformed configuration includes a forwardly displacement of the first panel-defined interacting counterpart 38. In some embodiments, for example, the forwardly displacement of the first panel-defined interacting counterpart 38 for transitioning of the interacting portion 25 from the pre-deformation configuration to the transitioning-effective deformed configuration is a displacement of the first panel-defined interacting counterpart 38 in a forwardly direction. In some embodiments, for example, the forwardly displacement of the first panel-defined interacting counterpart 38 for transitioning of the interacting portion 25 from the pre-deformation configuration to the transitioning-effective deformed configuration includes a displacement of the first panel-defined interacting counterpart 38 by a distance of at least 0.060 inches in a forwardly direction. In some embodiments, for example, the forwardly displacement of the first panel-defined interacting counterpart 38 for transitioning of the interacting portion 25 from the pre-deformation configuration to the transitioning-effective deformed configuration includes a displacement of the first panel-defined interacting counterpart 38 by a distance that is from 0.060 inches to 0.300 inches, in a forwardly direction. In some embodiments, for example, the forwardly displacement of the first panel-defined interacting counterpart 38 for transitioning of the interacting portion 25 from the pre-deformation configuration to the transitioning-effective deformed configuration includes a displacement of the first panel-defined interacting counterpart 38 by a distance of 0.1125 inches, in a forwardly direction.

In some embodiments, for example, the transitioning of the interacting portion 25 from the pre-deformation configuration to the transitioning-effective deformed configuration is effected by elastic deformation of the interacting portion 25.

In some embodiments, for example, the transitioning of the interacting portion 25 from the transitioning-effective deformed configuration to the interference-effective deformed configuration is effected by elastic deformation of the interacting portion 25.

In some embodiments, for example, while the first panel-defined interacting counterpart 38 and the second panel-defined interacting counterpart 66 are disposed in the relative movement interference relationship, and the second panel 20 is connected to a wall with a fastener 16, the covering portion 26 of the first panel 20 is covering the fastener 16.

In some embodiments, for example, the covering of the fastener 16 by the covering portion 26 of the first panel 20 is occluding of the fastener 16 by the covering portion 26 of the first panel 20.

In some embodiments, for example, the covering of the fastener 16 by the covering portion 26 of the first panel 20 is concealing of the fastener by the covering portion 26 of the first panel 20.

In some embodiments, for example, while the panel 20 is defining the first panel 20, which is co-operable with the second panel 20, the mountability of the panel 20 to the wall, for which the panel 20 is configured, is independent of its co-operability with the second panel 20.

In some embodiments, for example, a fastener 16 is receivable by the panel 20 for mounting of the panel 20 to a wall, such that the mountability of the panel 20 to the wall, for which the panel 20 is configured, is based upon the receiving of the fastener 16 by the panel 20. In some embodiments, for example, the receiving is with effect that the fastener 16 extends through the panel 20.

FIG. 2A illustrates the interacting portion 25 in accordance with an example embodiment. In some embodiments, for example, the covering flange portion 26 of the interacting portion 25 projects downwardly from the panel body front surface 28 a distance that is from 0.45 inches to two (2) inches (such as, for example, one (1) inch to two (2) inches), and which is selected to overlie an upper edge portion of a lower horizontally adjacent panel 20 or dry wall sheet 10. In some embodiments, for example, the covering flange portion 26 is provided having generally the same dimensional thickness as the front surface 28, which, in some embodiments, for example, provides the flange portion 26 with a degree of resilient or elastic deformation. In some embodiments, for example, the front covering flange portion 26 extends downwardly from the panel body 22, tapering rearwardly from the front panel plane PF towards the rear panel plane PR by a distance D that is from 0.030 inches to 0.150 inches (such as, for example, 0.040 inches and 0.080 inches) to a lowermost bottom edge 36. In some embodiments, for example, the front covering flange portion 26 extends downwardly from the panel body 22, tapering rearwardly from the front panel plane PF towards the rear panel plane PR by a distance D of 0.0625 inches. In some embodiments, for example, the rearwardly projecting rib 38 extends from the lowermost bottom edge 36 of the covering flange portion 26. In some embodiments, for example, the rib 38 is configured for either bearing engaging contact with the front facing surface of a next lower positioned sheet of dry wall 10, or against part of the upper connecting portion 24 of next adjacent lower panel 20. In some embodiments, for example, the covering flange portion 26 has a thickness selected such that the interacting portion 25 is resiliently deformable for movement between an unbiased position, or the pre-deformation configuration, shown in solid lines in FIG. 2A, where the bottom edge portion 36 is spaced rearwardly relative to the front panel plane PF, and a biased position, or the interference-effective deformed configuration, shown in stippled lining in FIG. 2A, wherein the bottom panel edge portion 36 is moved forwardly therefrom, and into generally co-planar alignment with the plane PF.

In some embodiments, for example, the second panel-defined interacting counterpart 66, for example, the longitudinally extending notch 66, is defined by the arm member 62, as illustrated in FIG. 3 to FIG. 5. In some embodiments, for example, the notch 66 is adopted to receive therein in a complimentary fit arrangement therein, the first panel-defined interacting counterpart 38, for example, the rib 38, of the next horizontally adjacent panel 20.

In some embodiments, for example, the deformability of the at least a portion the interacting portion 25 is such that the at least a portion of the interacting portion 25 is deflectable. In this respect, in some embodiments, for example, the interacting portion 25 is urged by a bias to a pre-deflection configuration, and the interacting portion is deflectable from the pre-deflection configuration to an interference-effective deflected configuration. While the first panel-defined interacting counterpart 38 of a first panel 20 and the second panel-defined interacting counterpart 66 of a second panel 20 are disposed in the relative movement interference relationship, the interacting portion 25 of the first panel 20 is disposed in the interference-effective deflected configuration, and interference, to relative movement, between the first panel 20 and the second panel 20, is established.

In some embodiments, for example, the deflectability of the at least a portion of the interacting portion 25 from the pre-deflection configuration, is also for effectuating transitioning of the interacting portion 25 to a transitioning-effective deflected configuration. In some embodiments, for example. the interacting portion 25 is deflectable from the pre-deflection configuration to a transitioning-effective deflected configuration, such that a deflection of the interacting portion, from the pre-deflection configuration to the transitioning-effective deflected configuration, is obtainable. In some embodiments, for example, while the interacting portion 25 is disposed in the transitioning-effective deflected configuration, and the second panel 20 is disposed in a co-operative alignment with the interacting portion 25, the interacting portion 25 is urged, by the bias, for displacement, relative to the second panel 20, with effect that the first panel 20 becomes disposed in the interference-effective deflected configuration.

FIG. 1 illustrates the completion of a finished wall 6 which incorporates panel wall assembly 8 in accordance with an example embodiment. Initially, one or more sheets of dry wall 10 are secured to the wall studs 12 to a desired height. Typically, the dry wall sheets 10 will extend vertically 3 to 6 feet from the floor 4. Following placement and securement of the sheets 10, the bevel groove 14 is formed along the rearward top edge of the dry wall sheet 10.

A first organizer panel 20 is then mounted horizontally against the dry wall sheet 10 in the position shown in FIG. 3 by locating the panel boss 34 in the bevel groove 14, and inserting screw fasteners 16 through the fastener pierceable body 54 into the studs 12. So positioned, the lower coveting flange portion 26 of the panel 20 is thus provided in resilient bearing contact with, and overlapping the upper edge of the dry wall panel 10, providing a prefinished appearance.

The remainder of the wall panel assembly 8 may then be completed by assembling subsequent organizer panels 20 in a horizontally stacked edge-to-edge relationship to provide the wall panel assembly 8 of a desired vertical height. As each next panel 20 is positioned, the boss 34 of the next adjacent panel 20 received in the channel groove 60 of the underlying panel 20, the shoulder member 56 of the underlying panel 20 is received in the channel groove 61 of the adjacent panel, and screw fasteners 16 are inserted through the fastener pierceable body 54 and into the studs 12 in the manner shown in FIG. 4. As each subsequent organizer panel 20 is positioned, the lower covering flange portion 26 overlies part of the upper connecting portion 24 of the adjacent lower panel, such that boss 38 of the covering flange portion 26 is provided in engaging contact within the arm notch 66 in a resilient fit, and the fastener 16 is covered by the covering flange portion 26.

In some embodiments, for example, the panel body 22, reinforcing wall 46, body 54 and arm member 62 define an L-shaped retention groove 64 therebetween.

As shown in FIGS. 1 and 4 with the positioning of the panels 20 in the stacked relationship, the panels 20 allow for suitable hangar members 80 to be suspended in a cam-fit arrangement within each L-shaped retention groove 64.

FIG. 4 shows an example embodiment of a hangar member 80 as including a generally planar back surface 82, which is configured for juxtaposed placement flush against the front surface 28 of the panel body 22, and further including a hooked end portion 84. The hooked end portion 84 includes a horizontal web 86 which extends from the upper edge of the hangar back 82 to an innermost finger 90. In some embodiments, for example, the finger 90 projects upwardly from the inner end of the horizontal web 86 at a forward angle $\alpha$ of between 60 and 85 degrees, for example, between 70 and 80 degrees. In some embodiments, for example, the finger 90 is configured so that the upper edge of the finger 90 engages the inner rearward surface of the arm member 62 within the retention slot 64.

The applicant has appreciated that the angular orientation of the finger 90 relative to the horizontal web 86 facilitates the positioning of the hangar member back 82 more fully against the front surface 28 of the panel body 22, when a load is suspended from the hangar member 80.

The preceding discussion provides many example embodiments. Although each embodiment represents a single combination of inventive elements, other examples may include all suitable combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations could be made herein.

Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be examples only. The invention is defined by the appended claims.

What is claimed is:

1. An organizer wall panel assembly comprising a plurality of panels, each of the panels comprising:

a panel body having a front surface, a wall engaging rear surface and horizontally extending upper and lower edges, the rear surface extending generally in a rear plane oriented vertically when the panel is mounted to a wall in use, the front surface extending generally in a front plane parallel to and spaced laterally forward from the rear plane;

an upper connection structure extending upwardly from the upper edge of the panel body, the upper connection structure including:

a vertical connecting web extending vertically upward from the upper edge and having a rear portion substantially coplanar with the rear surface for positioning against said wall;

a fastener receiving portion joined to the vertical connecting web, wherein the fastener receiving portion is spaced rearwardly from the front plane and includes a fastener pierceable body adapted to receive a mechanical fastener therethrough, and an upwardly extending shoulder member and a downwardly extending arm member, the shoulder member projecting upwardly from the pierceable body, the arm member projecting downwardly from the pierceable body a distance part way towards the upper edge, wherein the arm member, the pierceable body, and the panel body define at least in part a longitudinally extending retention groove sized for receiving an end portion of a hooked member therein; and a covering flange extending downwardly from the lower edge of the body panel adjacent the front surface to a flange bottom edge portion, wherein the covering flange of a first panel of the plurality of panels overlies the fastener receiving portion of the upper connection structure of a second panel of the plurality of panels that is mounted to the wall, and is coupled to, the first panel, and wherein the covering flange is resiliently deflectable relative to the panel body to move the flange bottom edge portion between:

an unstressed initial position, in which the flange bottom edge portion is spaced rearwardly from the front plane, and a stressed assembled position, in which the flange bottom edge portion is spaced forward of the unstressed initial position, and the covering flange of the first panel urges the flange bottom edge portion toward the unstressed initial position and against the upper connection structure of the second panel for exerting a holding force in a direction toward the wall that resists separation of the first and second panels.

2. The wall panel assembly of claim 1, wherein the shoulder member and the arm member define a longitudinally extending groove therebetween, the groove being sized to substantially receive therein the entirety of a head portion of said mechanical fastener.

3. The wall panel assembly of claim 2, wherein a forwardmost portion of the fastener receiving portion is spaced-rearwardly from the front plane.

4. The wall panel assembly of claim 3, wherein the arm member includes a horizontally extending notch, the flange bottom edge portion includes a rearwardly projecting rib, wherein the rib of the first panel is mated with the notch of the second panel when the second panel is mounted to the wall below and coupled to the first panel.

5. The wall panel assembly of claim 1, wherein the panel body, the upper connection structure, and the covering flange are integrally formed.

6. The wall panel assembly of claim 5, wherein each of said panels are formed as a unitary plastic, aluminum or polyvinyl chloride (PVC) extrusion.

7. An organizer wall panel assembly comprising a plurality of panels, each of the panels comprising:

a panel body having a front surface, a wall engaging rear surface and horizontally extending upper and lower edges, the rear surface extending generally in a rear plane, the rear surface for bearing against a wall when the panel is in use, the front surface extending generally in a front plane parallel to and spaced laterally forward from the rear plane;

an upper connection structure extending upwardly from the upper edge of the panel body; and a covering flange extending downwardly from the lower edge of the panel body to a flange bottom edge portion, wherein the covering flange of a first panel of the plurality of panels overlies a front surface of the upper connection structure of a second panel, wherein the covering flange is resiliently deflectable relative to the panel body between at least:

an unstressed initial position, in which the flange bottom edge portion is spaced rearwardly from the front plane, and a stressed assembled position, in which the flange bottom edge portion is spaced forward of the unstressed initial position, and the covering flange of the first panel exerts a holding force on the upper connection structure of the second panel in a direction toward the wall that resists separation of the first and second panels.

8. The wall panel assembly of claim 7, wherein the flange bottom edge portion comprises a flange rear surface directed toward the rear plane, a rearwardly projecting rib extending from a lower end of the flange rear surface, and a flange front surface opposite the flange rear surface.

9. The wall panel assembly of claim 8, wherein the flange front surface is inclined rearwardly toward the wall when the covering flange is in the unstressed initial position, and is coplanar with the front surface of the panel body when the covering flange is in the stressed assembled position.

10. The wall panel assembly of claim 8, wherein the upper connection structure includes a horizontally extending notch, and the rib of the first panel is insertable into the notch of the second panel when the second panel is mounted to the wall below, and coupled to, the first panel.

11. The wall panel assembly of claim 7, wherein the panel body is substantially hollow.

12. An organizer wall panel assembly comprising a plurality of panels, each of the panels comprising:

a panel body having a rear surface extending generally in a rear plane for bearing against a wall when the panel is in use, a front surface extending generally in a front plane parallel to and spaced laterally forward from the rear plane, and the panel body including horizontally extending upper and lower edges;

an upper connection structure extending upwardly from the upper edge of the panel body; and a covering flange extending downwardly from the lower edge of the panel body to a flange bottom edge portion for covering a front surface of the upper connection structure of a second panel when in an assembled condition with the first panel;

wherein the flange bottom edge portion of the covering flange comprises a flange rear surface directed toward the rear plane, a rearwardly projecting rib extending from a lower end of the flange rear surface, and a flange front surface opposite the flange rear surface, the flange front surface inclined rearwardly toward the rear plane when the covering flange is in the unstressed initial position, and the front flange surface coplanar with the front surface of the panel body when the covering flange is in the stressed assembled position;

wherein the covering flange is resiliently deflectable relative to the panel body between at least:

an unstressed initial position, in which the flange bottom edge portion is spaced rearwardly from the front plane and the flange front surface is inclined rearwardly toward the rear plane, and a stressed assembled position, in which the flange bottom edge portion is spaced forward of the unstressed initial position and the front flange surface is coplanar with the front surface of the panel body, wherein the covering flange of the first panel exerts a holding force against the upper connection structure of the second panel in a direction toward the rear plane that resists separation of the first and second panels.

* * * * *